US005674421A

United States Patent [19]

Beaver, II et al.

[11] Patent Number: 5,674,421

[45] Date of Patent: Oct. 7, 1997

[54] APPARATUS FOR AUTOMATED FOOD HANDLING

[75] Inventors: Robert I. Beaver, II, Atherton; William H. Sehestedt, Santa Clara, both of Calif.

[73] Assignee: Quadlux, Inc., Fremont, Calif.

[21] Appl. No.: 472,388

[22] Filed: Jun. 7, 1995

Related U.S. Application Data

[62] Division of Ser. No. 247,029, May 20, 1994, Pat. No. 5,534,679.

[51] Int. Cl.[6] ..... F27D 11/00

[52] U.S. Cl. ..... 219/385; 219/403; 219/754; 219/413; 99/447

[58] Field of Search ..... 219/752, 754, 219/755, 385, 386, 388, 403; 84/97; 392/418; 99/447

[56] References Cited

U.S. PATENT DOCUMENTS

| | | | |
|---|---|---|---|
| 500,371 | 6/1893 | Riessner et al. | 84/97 |
| 3,119,000 | 1/1964 | Loch et al. | 219/413 |
| 3,249,741 | 5/1966 | Mills | 219/388 |
| 3,448,678 | 6/1969 | Burstein | 99/386 |
| 3,660,637 | 5/1972 | Grove | 219/413 |
| 3,684,860 | 8/1972 | Snyder | 219/413 |
| 3,693,538 | 9/1972 | Snyder | 219/405 |
| 3,847,069 | 11/1974 | Guibert | 99/443 R |
| 3,935,807 | 2/1976 | Main et al. | 99/352 |
| 4,036,151 | 7/1977 | Shin | 219/754 |
| 4,092,512 | 5/1978 | Suzuki et al. | 219/754 |
| 4,121,078 | 10/1978 | Takano et al. | 219/754 |
| 4,210,794 | 7/1980 | Oguri | 219/754 |
| 4,225,767 | 9/1980 | Hatanaka et al. | 219/754 |
| 4,244,284 | 1/1981 | Flavan et al. | 99/327 |
| 4,276,465 | 6/1981 | Flavio | 219/388 |
| 4,421,015 | 12/1983 | Masters et al. | 99/332 |
| 4,501,944 | 2/1985 | Matsushima | 219/754 |
| 4,506,652 | 3/1985 | Baker et al. | 126/21 A |
| 4,554,437 | 11/1985 | Wagner et al. | 219/388 |
| 4,565,704 | 1/1986 | Dagerskog et al. | 426/233 |
| 4,687,895 | 8/1987 | Chitre et al. | 219/10.55 A |
| 4,734,562 | 3/1988 | Amano et al. | 219/413 |
| 4,960,977 | 10/1990 | Alden | 219/388 |
| 5,039,535 | 8/1991 | Lang et al. | 426/233 |
| 5,285,041 | 2/1994 | Wright | 219/717 |
| 5,315,092 | 5/1994 | Takahashi et al. | 219/497 |
| 5,378,872 | 1/1995 | Jovanovic | 219/388 |

FOREIGN PATENT DOCUMENTS 2180637 4/1987 United Kingdom .

*Primary Examiner*—Tu B. Hoang
*Attorney, Agent, or Firm*—Limbach & Limbach LLP

[57] ABSTRACT

An apparatus for automatically handling food cooked in an oven comprises a tray which is positioned inside an oven and which is automatically slidable into a position in which it extends partially out of the oven. During its outward travel, the tray pushes against an oven door to open the door. The tray has an automatic pulley assembly which, when the tray is positioned inside the oven, engages with a motor assembly located in the oven. When the pulley assembly and motor assembly are engaged, the pulley assembly rotates a grill positioned on the tray.

6 Claims, 7 Drawing Sheets

APPARATUS FOR AUTOMATED FOOD HANDLING

This is a divisional of application Ser. No. 08/247,029, filed May 20, 1994 U.S. Pat. No. 5,534,679.

FIELD OF THE INVENTION

This invention relates to the field of robotic material handling. More particularly, this invention relates to the field of cooking ovens having automatic food handling equipment.

BACKGROUND OF THE INVENTION

Ovens following the present invention and having linear sources of visible and infra-red radiant energy are disclosed and described in U.S. Pat. Nos. 5,036,179 and 5,217,067 which are incorporated herein by reference. These ovens provide high-speed, high-quality cooking and baking of food items by impinging high-intensity visible, near-visible, and infrared radiations onto a food item. The ovens cook the food items within the short periods of time normally found in microwave cooking while maintaining the browning of infrared cooking and the quality of conduction-convection cooking. When food is exposed to a sufficiently intense source of visible, near-visible, and infrared radiation, the food absorbs low levels of visible and near-visible radiation, thereby allowing the energy to penetrate the foodstuff and heat it deeply. The longer infrared radiation does not penetrate deeply but acts as an effective browning agent.

Ordinarily, the source of the visible, near-visible and infrared radiation for this invention is in excess of two elongated quartz-halogen tungsten lamps, or equivalent means such as quartz arc lamps. Typical quartz-halogen lamps of this type operate at 3000 degrees Kelvin and convert electrical energy into black body radiation having a range of wavelengths from 0.4 μm to 4.5 μm with a peak intensity at 0.965 μm. Each lamp can generally provide about between 1.5 and 2 kW of radiant energy with a significant portion of the energy in the visible light spectrum.

The ovens can use a plurality of these lamps or an array of several lamps either operated in unison or selectively operated in varying combinations as necessary for the particular food item sought to be cooked. These radiation sources are ordinarily positioned above and below the food item. The walls of the surrounding food chamber are preferably made from highly reflective surfaces. The visible and infrared waves from the radiation sources impinge directly on the food item and are also reflected off the reflected surfaces and onto the food item from many angles. This reflecting action improves uniformity of cooking.

Because of the great speed with which lightwave ovens are capable of cooking and the high intensity of the lamps used in lightwave cooking, great care must be taken to prevent overcooking of some or all areas of the food item. For example, the areas of the food item that are positioned directly above or below the radiation sources receive more direct energy and therefore cook more quickly than their surrounding areas, because the intensity of radiant energy received by an object decreases with the increase in distance between the object and the radiant energy source. It is therefore desirable to rotate the food relative to the lamps in order to distribute the light intensity more evenly over the food surface.

It is likewise desirable to remove a cooked food item from a lightwave oven soon after cooking, since even after the radiant energy sources have been turned off at the end of a cooking cycle, heat accumulating in the oven can cook the food by conduction and can thereby cook the food beyond the desired degree of "doneness."

Finally, given the substantially reduced cooking times that have been achieved using lightwave ovens, the food handling time has become one of the more substantial limiting factors in preparing cooked food items. An apparatus is therefore needed which reduces the amount of operator handling of the food. In particular, it is desireable to have automatic means for unloading the cooked food item from the oven and for delivering it onto a work surface.

SUMMARY OF THE INVENTION

The present invention is directed to an oven having robotic components that address some of the above-described problems associated with lightwave cooking. Specifically, the oven of the present invention includes a rotatable food location, which helps prevent overexposure of certain food areas to the highest intensity energy areas located directly above or below the radiant energy sources, and a robotic door mechanism which includes a shelf for holding the food during cooking and means for automatically opening the oven door and ejecting the tray from the oven after the cooking cycle has ended.

DETAILED DESCRIPTION OF THE DRAWINGS

DETAILED DESCRIPTION OF THE PREFERRED EMBODIMENT

Figure 1:
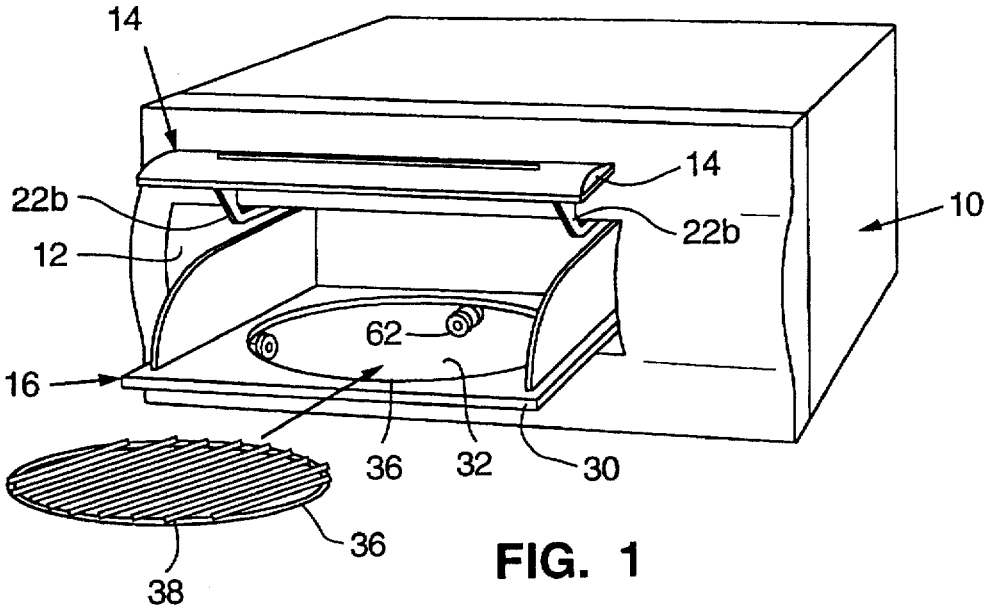
FIG. 1 is a perspective view of an oven having a door mechanism and rotating grill according to the present invention, showing the oven door in the open position.

FIG. 1 is a perspective view of the preferred embodiment of the present invention. An oven having the features of the preferred embodiment is the Model FB-3000 lightwave oven which is manufactured and sold by Quadlux, Inc.

Figure 2:
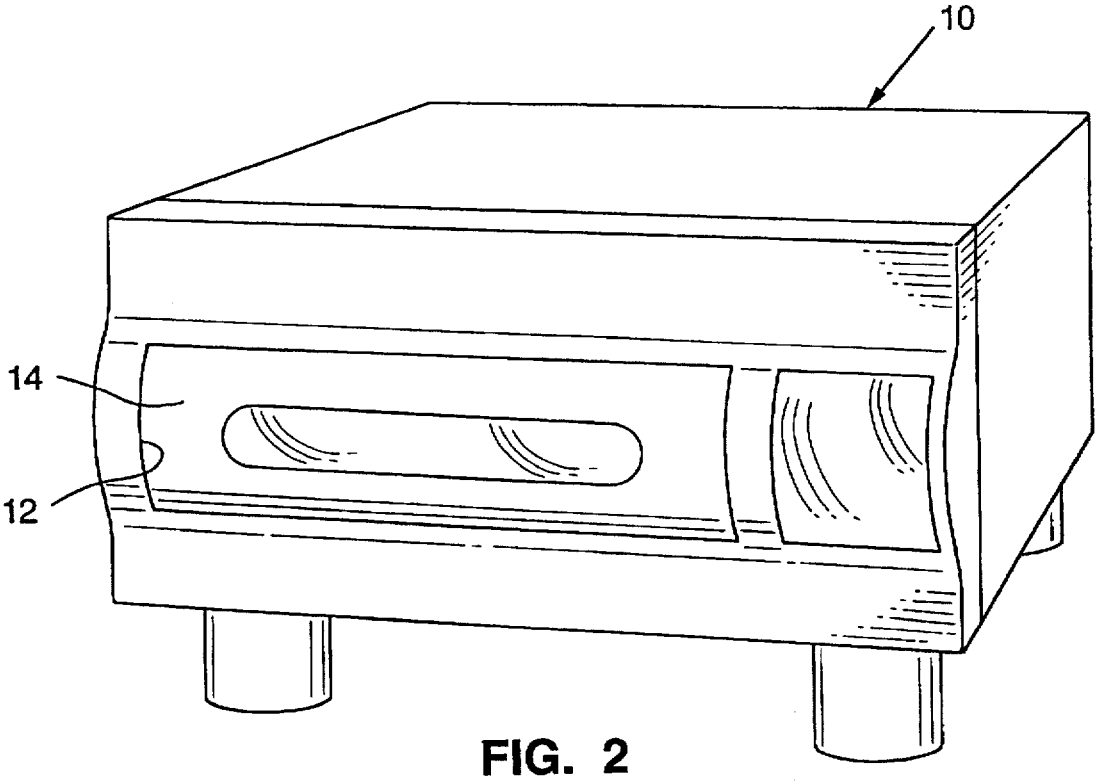
FIG. 2 is a perspective view of the oven of FIG. 1 with the oven door in the closed position.

The oven of the preferred embodiment is comprised generally of an oven housing 10 having an opening 12 and a door 14 which is movable between an open position (FIG. 1) in which the door 14 is pivoted away from the opening 12, and a closed position (FIG. 2) wherein the door 14 is covering the opening 12. A tray 16 is positioned inside the oven chamber and is slidable between an inside position wherein it is fully within the oven 10 and an extended position (FIG. 1) wherein the tray 16 is extending at least partially out of the oven 10. As will be described in detail, movement of the tray 16 from its inside position to its extended position causes the door 14 to release and to pivot open.

Figure 3:
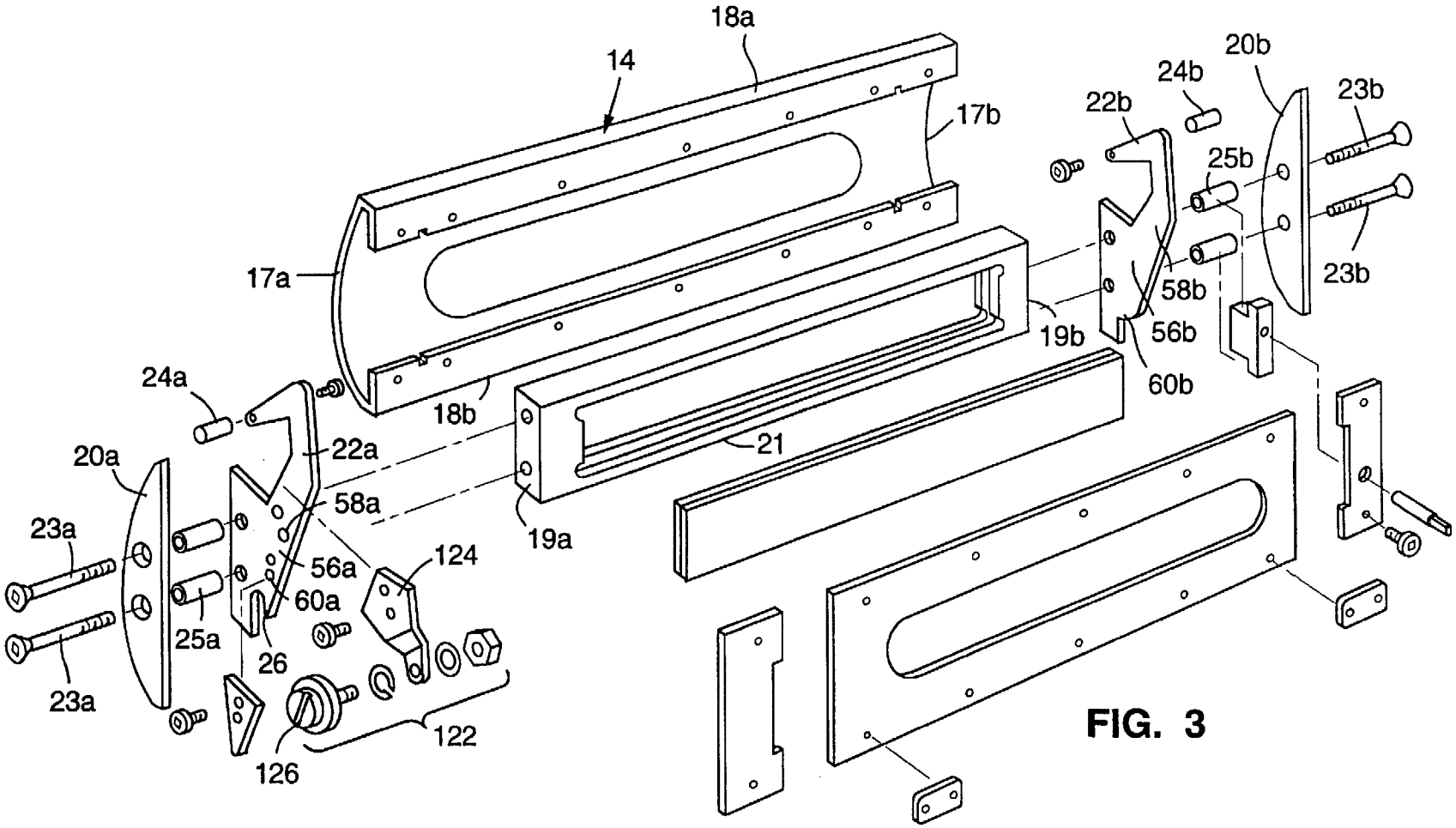
FIG. 3 is an exploded view of an oven door having a hinge mechanism according to the present invention.

FIG. 3 shows an exploded view of the door 14 according to the preferred embodiment. The door 14 is an elongate member having upper and lower elongate sides 18*a*, 18*b*, respectively, and a pair of short sides 17*a*, 17*b* extending between the elongate sides 18*a*, 18*b*. The door 14 has an elongate bezel 21 enveloped within it and having a pair of sides 19*a*, 19*b*. Mounted to each of the sides 19*a*, 19*b* is a hinge member 22*a*, 22*b*, respectively, which is secured in place by a side plate 20*a*, 20*b* and by bolts 23*a*, 23*b* passing through the side plates and hinge members and into the bezel 21. Spacers 25*a*, 25*b* separate the hinge members 22*a*, 22*b* from the side plates 20*a*, 20*b* such that, when assembled, each hinge member spaced from its respective side 17*a*, 17*b* of the door (see FIG. 6).

Figure 4:
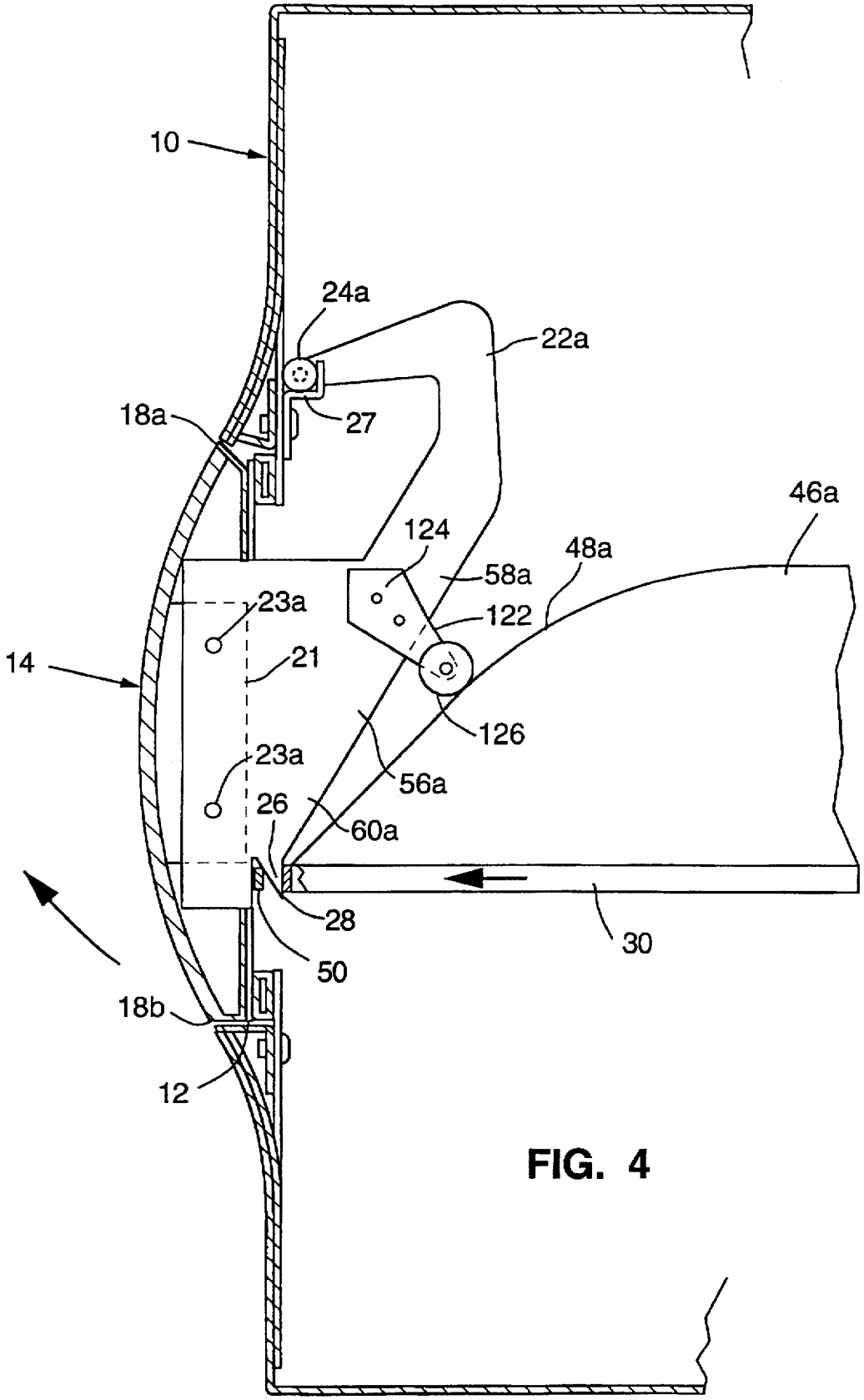
FIG. 4 is a side view of an oven having the door mechanism of the present invention, showing the oven with a side panel removed to shown the interaction of the door hinge with one of the tapered walls on the tray.

Pivot pins 24*a*, 24*b*, connects the hinge members 22*a*, 22*b*, respectively to brackets 27 of the oven housing 10 as shown in FIG. 4. Each of the hinge members 22*a*, 22*b* is pivotable around its respective pivot pin 24*a*, 24*b* to pivot the door 14 in the direction indicated by an arrow in FIG. 4.

Each of the hinge members 22*a*, 22*b* has a tapered shape. Tapered portion 56*a*, 56*b*, respectively, of each hinge has a wide portion 58*a*, 58*b*, respectively, and a narrow portion 60*a*, 60*b*, respectively. With the door in the closed position shown in FIG. 4, the tapered portions 56*a*, 56*b* are oriented such that the wide portions 56*a*, 56*b* are above the narrow portions narrower portion 60*a*, 60*b*.

As shown in FIGS. 3–4, hinge member 22*a* is provided with a catch tab 26 near the lower elongate side 18*b* of the door 14. The catch tab 26 is a substantially triangular member having a downwardly extending point 28.

Also mounted to the hinge member 22*a* is a cam roller assembly 122. The roller assembly 122 comprises a roller arm 124 mounted to and extending away from the hinge member 22*a* (i.e. towards the interior of the oven when the door is closed) as shown in FIG. 3. Coupled to the roller arm 124 is a roller 126.

Figure 5:
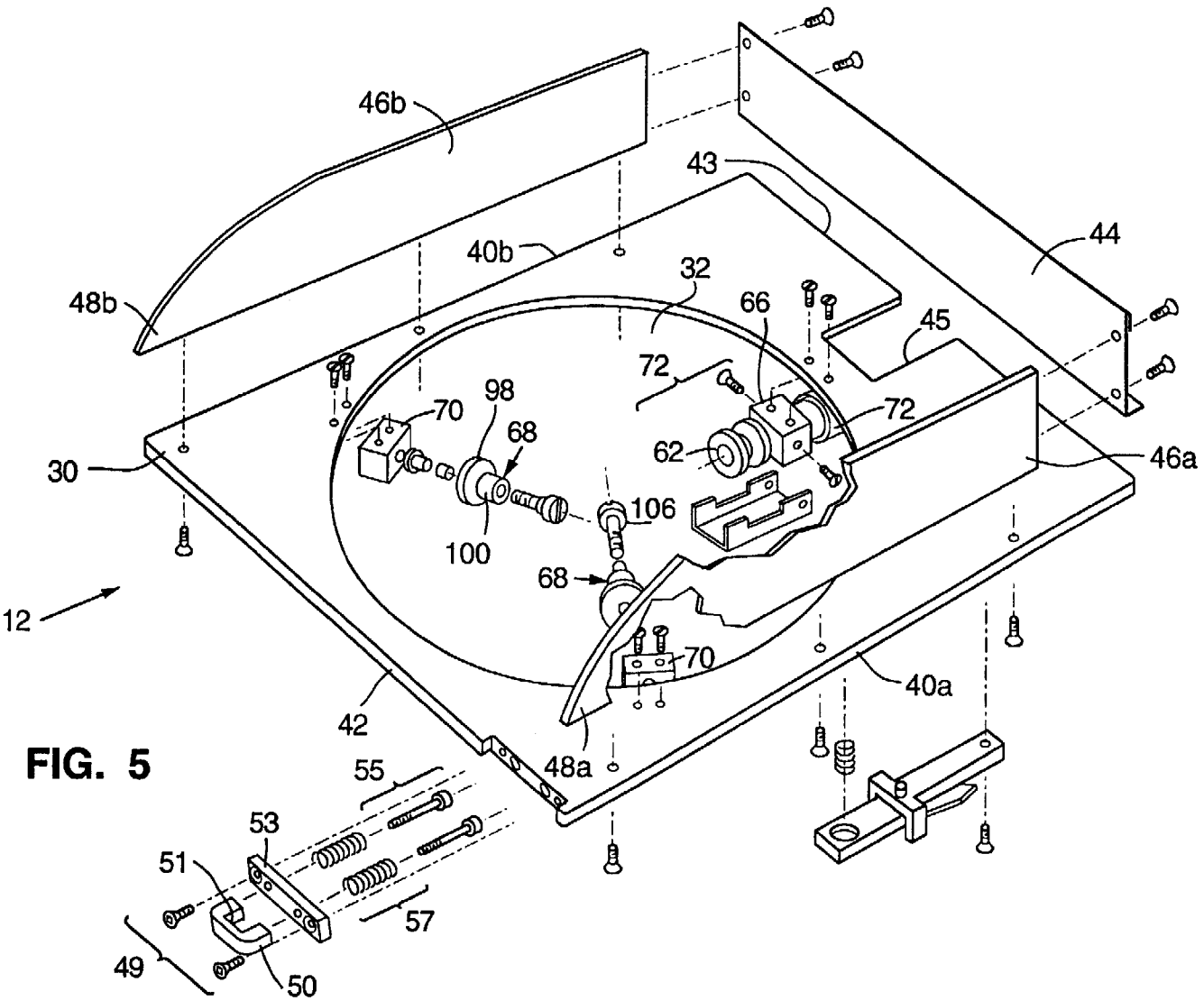
FIG. 5 is an exploded view of an oven tray according to the present invention.

Referring to FIG. 5, the tray 12 is comprised of a substantially rectangular plate 30 having a circular cut-out portion 32 which, as can be seen in FIG. 1, receives a circular grill 38. The plate 30 has a pair of side edges 40*a*, 40*b*, a forward edge 42 and a rear edge 43. The side edges 40*a*, 40*b* are substantially parallel to each other, and they are substantially perpendicular to the forward and rear edges. A slot 45 is centered along the rear edge 43 of the plate 30.

A wall 44 extends substantially normally of the plate 30, between the cut-out portion 32 and the rear wall 43. Extending from the wall 44 in a direction towards forward edge 42 of the plate are a pair of camming walls 46*a*, 46*b*. The camming walls 46*a*, 46*b* are substantially parallel to each other and are located on opposite sides of the cut-out portion 32. Each camming wall 46*a*, 46*b*, has a tapered camming edge 48*a*, 48*b* near forward edge 42 of the plate 30.

A catch member assembly 49 is secured to forward edge 42 of the plate 30, near side edge 40*a*. The catch member assembly 49 is comprised of a U-shaped catch member 50 which is secured to a bar 53 by a pair of long screws 55 that are also connected to the forward edge 42 of plate 30. The catch member 50 and the bar 53 define an opening 51 between them which, when the door 14 is in the closed position, receives the catch tab 26 of the hinge 22*a* (FIG. 4).

The bar 53 and the forward edge 42 are separated by springs 57 disposed around the screws 55. The springs 57 bias the bar 53 slightly to compensate for the expansion and contraction of the various components of the catch member assembly 49 during heating and cooling, respectively, of the oven.

Figure 6:
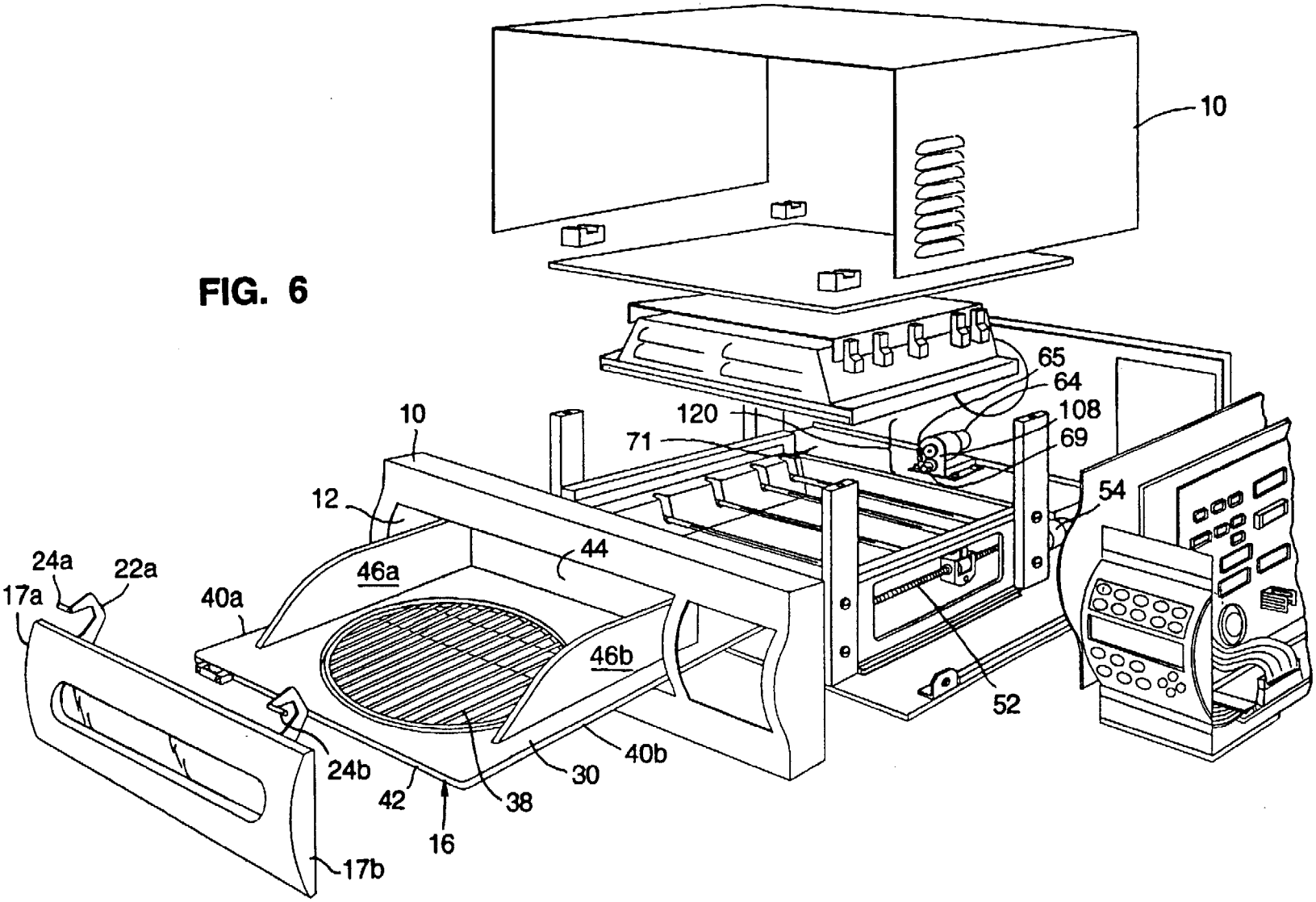
FIG. 6 is an exploded view of the oven of FIG. 1.

As shown in FIG. 6, the tray 16 is slidable by means of a leadscrew 52 that is driven by a motor 54 in a conventional manner. The plate 30 is coupled to the lead screw 52 by means of a conventional leadscrew nut (not shown) which is mounted to the underside of the plate 30 and which translates the rotary motion of the lead screw nut 52 into corresponding linear motion.

Upon completion of a cooking cycle, the tray 16 moves from inside the oven through the opening 12 in the oven housing 10 by activation of the motor 54. As the tray 16 moves through the opening 12, camming wall 46*a* pushes against the roller 126 on the hinged member 22*a*. (see FIG. 4). Because of the tapers of the camming walls 46*a*, 46*b*, this movement causes the hinge members 22*a*, 22*b* to pivot upwardly around their respective pivot pins 24*a*, 24*b* to the position shown in FIG. 1. The action of the camming walls against the roller 126 also causes a slight upward movement of the hinge members 22*a*, 22*b* which is sufficient to lift the catch tab 26 out of engagement with the catch member 50.

The grill 38 and the motorized mechanism for rotating the grill 38 will next be described.

The grill 38 is formed of a circular metallic ring 36 and a plurality of parallel cross-bars secured at their ends to the ring 36. The ring 36 has a uniform circular cross-section (see FIG. 8).

Referring to FIG. 5, a pulley assembly 72 is secured to the underside of the plate 30 by its support member 66 such that a pulley 62 extends beneath the cut-out portion 32 of the plate 30.

Figure 7:
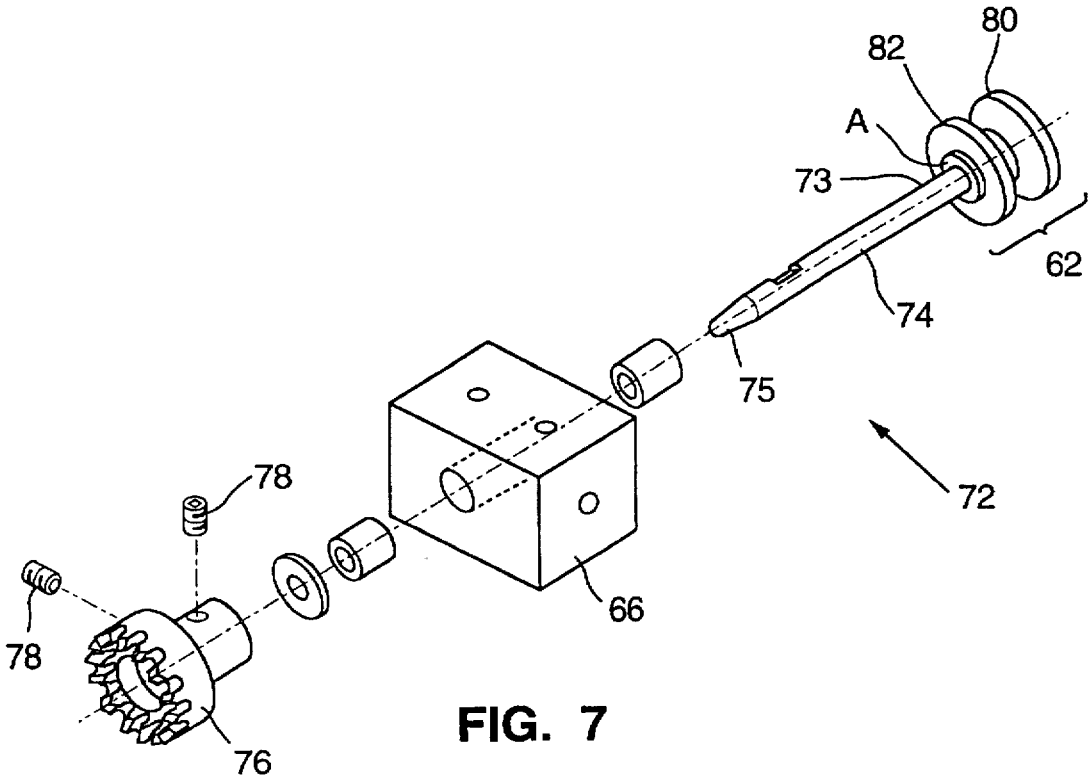
FIG. 7 is an exploded view of the pulley assembly used to rotate the grill.

An exploded view of the pulley assembly 72 is shown in FIG. 7. The pulley assembly 72 is comprised of a pinch roller type pulley 62 having a shaft 74 extending through, and rotatable within, support member 66. A gear 76 is coupled by set screws 78 to the shaft 74 such that the pulley 62 is at first end 73 of the shaft 74 and the gear 76 is at second end 75. Rotation of the gear 76 thus produces corresponding rotation of the pulley 62.

Figure 8:
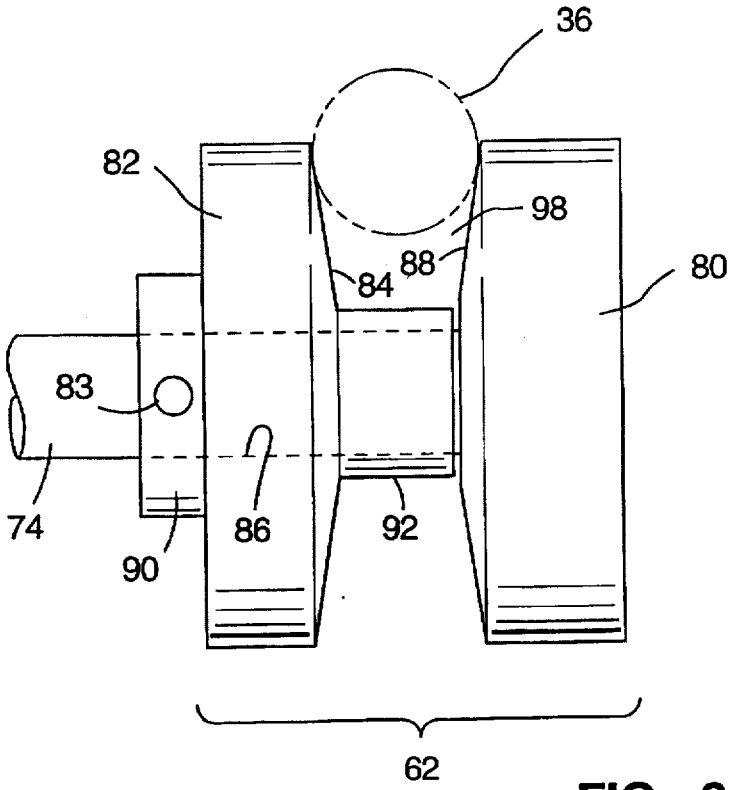
FIG. 8 is a side view of the pulley of the pulley assembly of FIG. 7.
Figure 9:
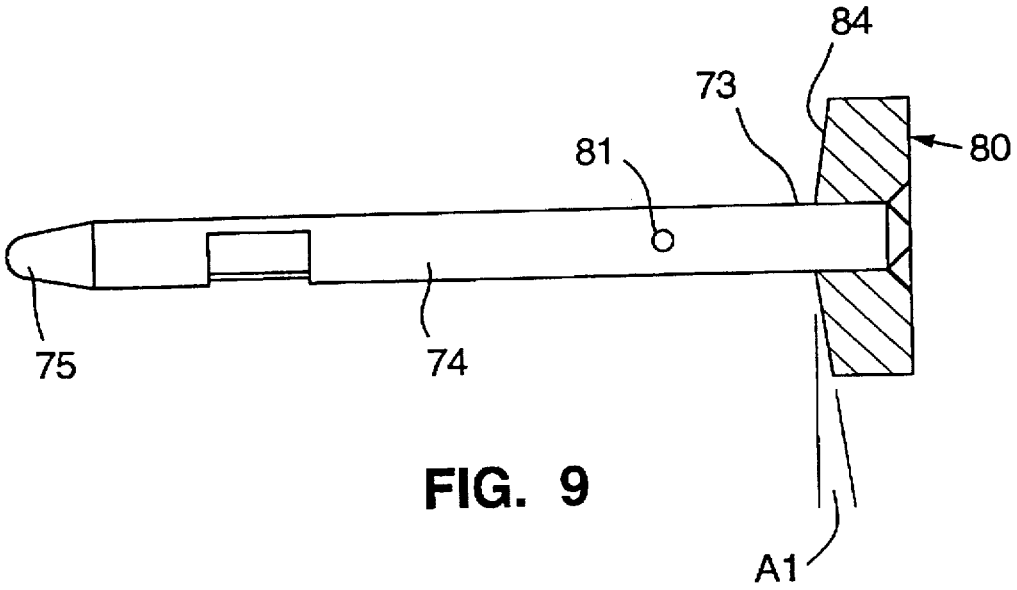
FIG. 9 is a side section view of the first pulley side and the pulley shaft.

Referring to FIG. 8, the pulley is comprised of a first pulley side 80 and a second pulley side 82. The first pulley side 80, shown separately in FIG. 9, is preferably welded to first end 73 of the shaft 74. It has an engaging surface 84 angles away from the shaft by an angle A1, measured from a plane perpendicular to the longitudinal axis of the shaft 74. In the preferred embodiment, angle A1 is preferably 7°–8°.

Figure 10:
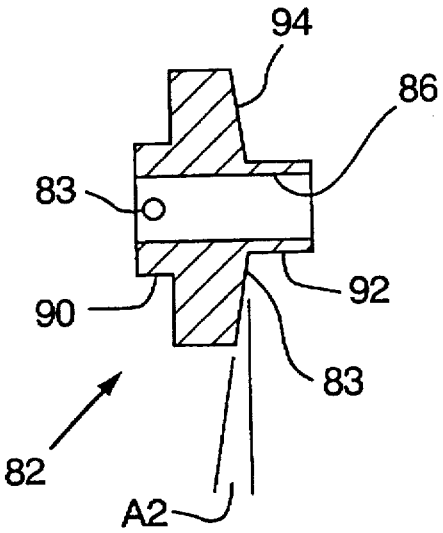
FIG. 10 is a side section view of the second pulley side.

Second pulley side 82 is shown in cross-section in FIG. 10. It is comprised of a first tubular end 90 and a second tubular end 92 which is longer than the first tubular end 90. A through hole 86 proportioned for receiving the shaft 74 extends longitudinally through the pulley side 82.

A wheel portion 94 is positioned between the tubular ends 90, 92. The wheel portion 94 has an engaging surface 88 surrounding the through hole 86. The engaging surface 88 is angled away from a plane perpendicular to the longitudinal axis of the through hole 86 by an angle A2, which is preferably 7°–8°.

Referring to FIG. 8, the pulley sides 80, 82 are assembled bypassing shaft 74 through the through hole 86 on the pulley side 82. The sides 80, 82 are secured in the assembled condition by conventional means, such as by a pin (not shown) extending through a first hole 81 on the shaft 74 (FIG. 9) and through a second hole 83 (FIG. 10) in the tubular portion 90 of the second pulley side 82.

When the pulley assembly 72 is assembled, the angled surfaces 84, 88 are angled away from each other as shown, and the long tubular portion 92 of the pulley side 82 extends between the two pulley sides 80, 82. A slot 98 have a U-shaped cross-section is thus formed between the pulley sides 80, 82. The slot 98 is proportioned to partially receive the ring 36 of grill 38 and to impart rotational force to the ring 36 when the pulley assembly 72 is rotated. The slot 98 should be proportioned such the ring makes contact with both of the pulley sides 80, 82 in order to ensure that the rotational force is imparted to the ring 36. In the preferred embodiment, the inner perimeter of the ring 36 contacts the pulley side 80 at two points and the outer perimeter of the ring 36 contacts the pulley side 82 at one point.

In the preferred embodiment, the ring 36 has a 0.25 inch diameter cross-section. The preferred pulley assembly 72 is precision machined such that the pulley sides 80, 82 are separated by a distance of 0.26 inches at their outermost edges and such that the tubular portion 92 is separated from the pulley side 80 by a distance of 0.01 inches. In order to withstand the tremendous heat generated inside the oven during cooking, the pulley assembly is preferably made of hardened stainless steel which has been heat treated to Rockwell "C" 40 or harder.

Figure 11:
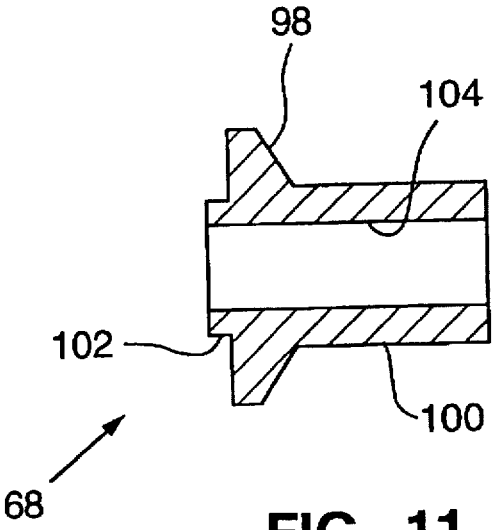
FIG. 11 is a side section view of an idle roller.

Referring again to FIG. 5, idle rollers 68 are secured by support members 70 to the underside of the plate 30 and they extend beneath the cut-out portion 32. An idle roller 68, which is shown in cross-section in FIG. 11, is comprised of a wheel portion 98, a first end portion 100, and a second end portion 102. A throughbore 104 passes longitudinally through the roller 68 and is proportioned for receiving a bolt 106 (see FIG. 5). The wheel portion 98 angles away from the end portion 100 at an angle A3 which is preferably 35° plus or minus 2° from a plane perpendicular to the longitudinal axis of the throughbore 104.

Referring to FIG. 5, each idle roller 68 is mounted to its respective support member 70 by a bolt 106, with the end portion 100 of the roller 68 extending radially towards the center of the circular cutout 32. During operation, the grill 38 (FIG. 1) is positioned within the cutout such that its perimeter 36 is supported by the idle rollers 68 at their respective end portions 100 and by the pulley 62. Each roller 68 must be coupled to its respective support member 70 in a manner which will allow it to freely rotate in response to the rotation of the grill 38. The pulley 62 and the rollers 68 are preferably spaced from each other by approximately 120° so as to provide balanced support for the grill 38.

Other means, besides the rollers, may be provided for supporting the grill 38 during the rotation. For example, a track may be formed along the perimeter of the cutout 32, and a slot formed in the track to allow the pulley to engage with the grill. The perimeter of the grill would then slide along the track during rotation.

A motor assembly 120 (FIG. 6) for driving the pulley 62 is mounted within the main oven housing 10. The motor assembly 120 is mounted to a stage 71 inside the housing 10 by a L-shaped plate 108 and is positioned such that it is disposed within the slot 45 (FIG. 5) on the plate 30 when the tray 16 is in its inside position. The motor assembly 120 is comprised of a motor 64 mechanically coupled to a system of gears 65 by conventional means such that activation of the motor 64 produces rotation of the gears. The gears 65 are configured such that gear 69 of the gear system 65 engages with the gear 76 of the pulley assembly 72 (FIG. 7) when the tray 16 is inside the oven and disengages with the gear 76 when the tray 16 begins to slide to its outside position. Thus, when the tray 16 is in its inside position and the motor 64 is activated, the resultant rotation of the gears 65 produces corresponding rotation of the gear 76 and thus the pulley 62. The gears 65 are preferably spring loaded to allow engagement with the gear 76 even when the gears 69, 76 are slightly misaligned with each other.

During use of the oven the grill 38 is positioned on such that ring 36 sits on the pulley 62 and rollers 68. Pulley 62 rotates upon activation of motor 64 thereby causing rotation of the grill 38. Rotation is facilitated by the rollers 68 which roll in response to movement by the grill 38. This rotation of the grill 38, and thus the food positioned on the grill, enhances uniformity of cooking by preventing radiant energy from the cooking lamps in the oven (not shown) from being focused onto any specific regions of the food item.

The present invention has been described in relation to the preferred embodiment but is limited only in terms of the language of the appended claims.

What is claimed is:

1. An apparatus for rotating a tray, the tray having a rail defining a circle, the apparatus comprising:

a motor;

a rotatable pulley coupled to the motor, the pulley having a circumferential slot configured for receiving a portion of the rail and for imparting a rotational force on the rail; and means for supporting the tray.

2. The apparatus of claim 1 wherein the means for supporting the tray comprises a base and at least one roller positioned on the base for rolling engagement with the rail during rotation of the tray.

3. An apparatus for rotating a tray, the tray having a rail defining a circle, the apparatus comprising:

a motor;

a rotatable pulley coupled to the motor, the pulley having a slot configured for receiving a portion of the rail and for imparting a rotational force on the rail, wherein the pulley includes:

a rod having first and second ends, the first end coupled to the motor;

a first pulley wheel attached to the second end of the rod;

a second pulley wheel spaced from the first pulley wheel and attached to the second end of the rod; and means for supporting the tray.

4. The apparatus of claim 3 wherein the second pulley has a bore and wherein the rod extends through the bore.

5. The apparatus of claim 3 wherein the first and second pulley wheels each have beveled sides facing one another, each beveled side angling away from the other of the beveled sides.

6. An apparatus for rotating a tray, the apparatus comprising:

a circular tray having an edge, a plate having a circular opening;

a motor;

a rotatable pulley coupled to the motor and extending beneath the circular opening in the plate, the pulley having a slot configured for receiving a portion of the edge of the tray and for imparting a rotational force on the edge of the tray;

at least one roller mounted to the plate and extending beneath the circular opening, the roller positioned for rolling engagement with the edge of the tray, the tray being mounted on the pulley and the roller and positioned within the circular opening.

* * * * *